US010960410B2

(12) United States Patent
Casa et al.

(10) Patent No.: US 10,960,410 B2
(45) Date of Patent: Mar. 30, 2021

(54) ACCELERATOR DISC FOR A DISC STACK SEPARATOR

(71) Applicant: ANDRITZ Frautech S.r.l., Schio (IT)

(72) Inventors: Daniele Casa, Schio (IT); Damon Cecchellero, Piovene Rocchette (IT)

(73) Assignee: Andritz Frautech S.r.l., Schio (IT)

( * ) Notice: Subject to any disclaimer, the term of this patent is extended or adjusted under 35 U.S.C. 154(b) by 516 days.

(21) Appl. No.: 15/825,177

(22) Filed: Nov. 29, 2017

(65) Prior Publication Data

US 2018/0147579 A1 May 31, 2018

(30) Foreign Application Priority Data

Nov. 30, 2016 (EP) ..... 16201461

(51) Int. Cl.
*B04B 7/14* (2006.01)
*B04B 11/06* (2006.01)
*B04B 1/08* (2006.01)

(52) U.S. Cl.
CPC ..... *B04B 7/14* (2013.01); *B04B 1/08* (2013.01); *B04B 11/06* (2013.01)

(58) Field of Classification Search
CPC .. B04B 7/14; B04B 11/06; B04B 1/08; B04B 1/00; B04B 7/00
USPC ..... 494/43, 65, 70
See application file for complete search history.

(56) References Cited

U.S. PATENT DOCUMENTS 4,067,494 A * 1/1978 Willus ..... B04B 1/12 494/35
5,374,234 A * 12/1994 Madsen ..... B04B 1/20 494/53
2013/0072369 A1* 3/2013 Zhang ..... B04B 1/10 494/42

FOREIGN PATENT DOCUMENTS

EP 2767344 A1 * 8/2014 ..... B04B 11/06

* cited by examiner

*Primary Examiner* — Walter D. Griffin
*Assistant Examiner* — Shuyi S. Liu
(74) *Attorney, Agent, or Firm* — Alix, Yale & Ristas, LLP

(57) ABSTRACT

A disc stack separator and an accelerator disc for a disc stack separator, especially a centrifugal nozzle separator, has curved blades mounted on a cone-shaped shell. The blade configuration assists in directing flow to space for the nozzles in the centrifugal separator bowl in an optimal manner, thus reducing the power consumption of the separator.

13 Claims, 4 Drawing Sheets

ACCELERATOR DISC FOR A DISC STACK SEPARATOR

BACKGROUND

The disclosure relates to an accelerator disc for a disc stack separator and a disc stack separator using such accelerator disc.

A disc stack separator consists of a feed pipe for a suspension or solid/liquid mixture, a stack of filter discs, an accelerator disc and a bowl. The solid/liquid mixture is directed by the feed pipe to a so called accelerator disc which directs the mixture into the rotating bowl. The accelerator disc has the form of a cone with its top pointing upwards towards the feed pipe and fitting underneath the stack of filter discs. While the feed pipe is stationary, the accelerator or accelerator disc and the bowl rotate normally at a speed of up to 15,000 rpm. In the disc stack, which is also rotating, the mixture is separated into a light fraction and a heavy fraction, which may include solid particles. The whole mixture is transported by a feed pipe into the accelerator. The light and heavy fraction are separated and moved through the accelerator by the centripetal pumps to the outlet.

The heavy fraction will be discharged from the periphery of the bowl at regular time intervals.

The heavy and light fraction is transported by the centripetal pumps through channels in the rotating shaft upwards and discharged through a discharge pipe. The heavy fraction is discharged through nozzles in the wall of the bowl in case of a nozzle separator. Due to the rotation, the light fraction concentrates in the centre and the heavy fraction is sent to the circumference.

SUMMARY

Accelerator discs are used in the state of the art to distribute the flow of suspension or a mixture to the filtering area like a stack of filter discs. The disclosed embodiments are useful to eliminate the drawbacks of the state of the art and provide an accelerator disc for a disc stack separator with reduced energy consumption. This is achieved by utilizing blades of the accelerator disc that are curved. With such a configuration the flow can be directed to the space for the nozzles in the disc stack separator bowl already in an optimal manner.

A further favourable embodiment is characterized in that the blades are curved counter to the direction of rotation. This allows use of the energy of the flow without any slowing down, and thus reduces the necessary energy for the transport of the suspension or mixture, and thus reduces the overall power consumption of the instrument. This is especially of use with suspensions with high specific gravity, e.g. up to 2.0 g/l (kg/m$^3$).

Another advantageous embodiment is characterized by additional blades extending only along a part of the surface of the accelerator disc and being arranged between blades extending along the whole surface, whereby the additional blades extending only along a part of the surface may have a wider profile than the blades extending along the whole surface of the accelerator disc. These additional blades allow the distribution and transport of a considerable amount of suspension and thus the throughput can be increased considerably.

The disclosure is also related to a disc stack separator, and especially a centrifugal nozzle separator. The inventive disc stack separator is provided with an accelerator disc like that described above.

BRIEF DESCRIPTION OF THE DRAWING

The disclosed embodiment are now described in detail with regard to the drawings where.

DETAILED DESCRIPTION

Figure 1:
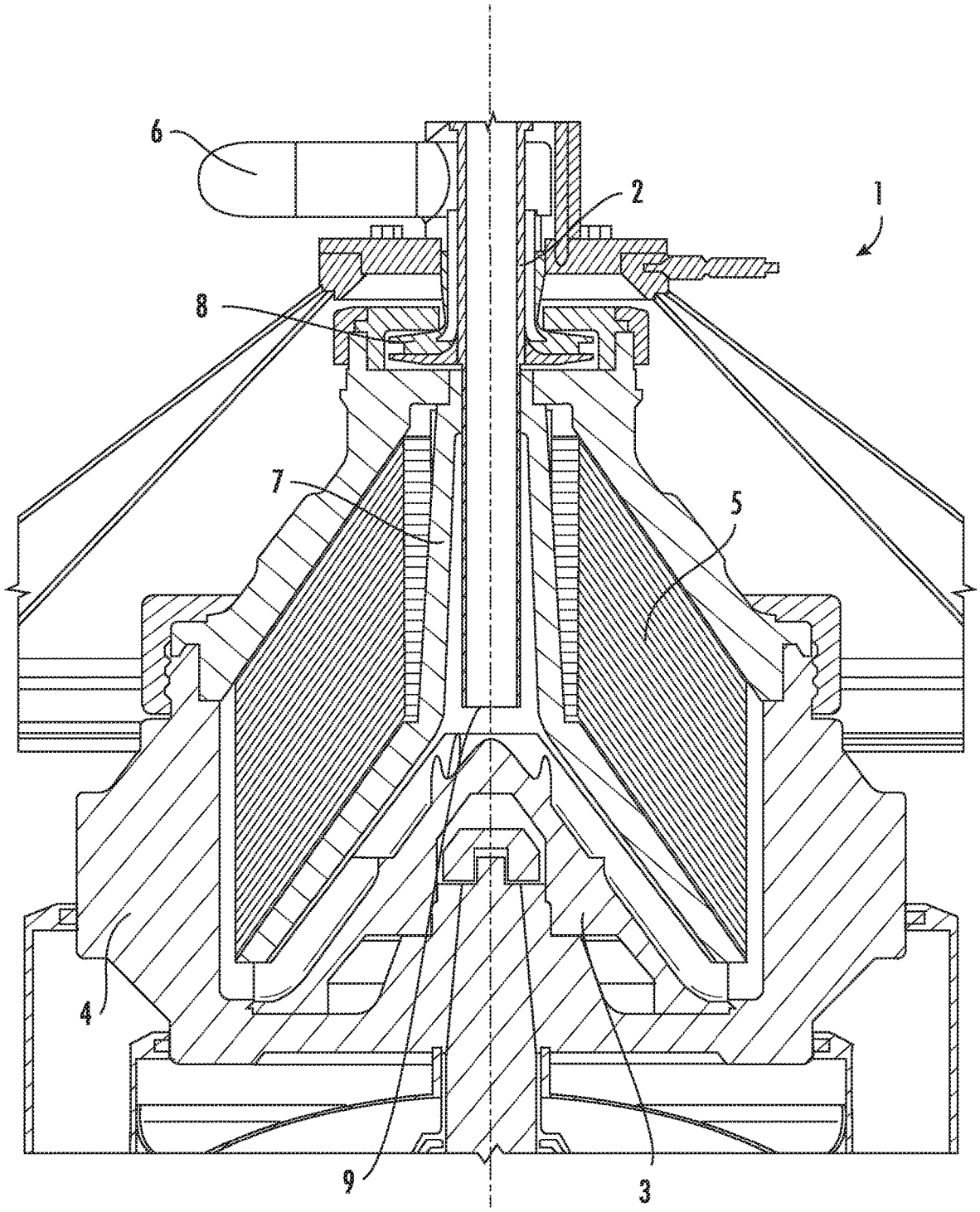
FIG. 1 shows a section of a disc stack separator, especially a centrifugal nozzle separator, within which the disclosed disc is used.

FIG. 1 shows a nozzle separator 1 as a special design of a disc stack separator, with a feed pipe 2 for the feed of the solid/liquid mixture. This mixture is directed to a so called accelerator or accelerator disc 3 which directs the mixture into the rotating drum or bowl 4. The accelerator disc has the form of a cone with its top pointing upwards towards the feed pipe and fitting underneath the stack of filter discs 5. In the disc stack 5, the mixture is separated into a light fraction which is discharged through discharge pipe 6 and a heavy fraction which is discharged through nozzles, continuously in a nozzle separator, intermittently in a separator. Due to the rotation, the light fraction concentrates in the center and the heavy fraction is sent to the circumference. The suspension or mixture is introduced into the disc stack separator 1 through feed pipe 2 which is arranged in the hollow shaft of the distributor 7 also carrying the disc stacks, where the light fraction is pumped upwards through a channel in the distributor 7 by a centripetal pump 8 to the discharge pipe 6. The feed pipe 2 extends from the top of the separator 1 through the stack of filter discs 5 and the opening 9 of the feed pipe 2 is directed to the top of the accelerator disc 3 of the separator bowl 4. The accelerator disc 3 is fixed to the separator bowl 4 and rotates with it. Also the disc stack 5 rotates, while the feed pipe 2 is stationary.

Figure 2:
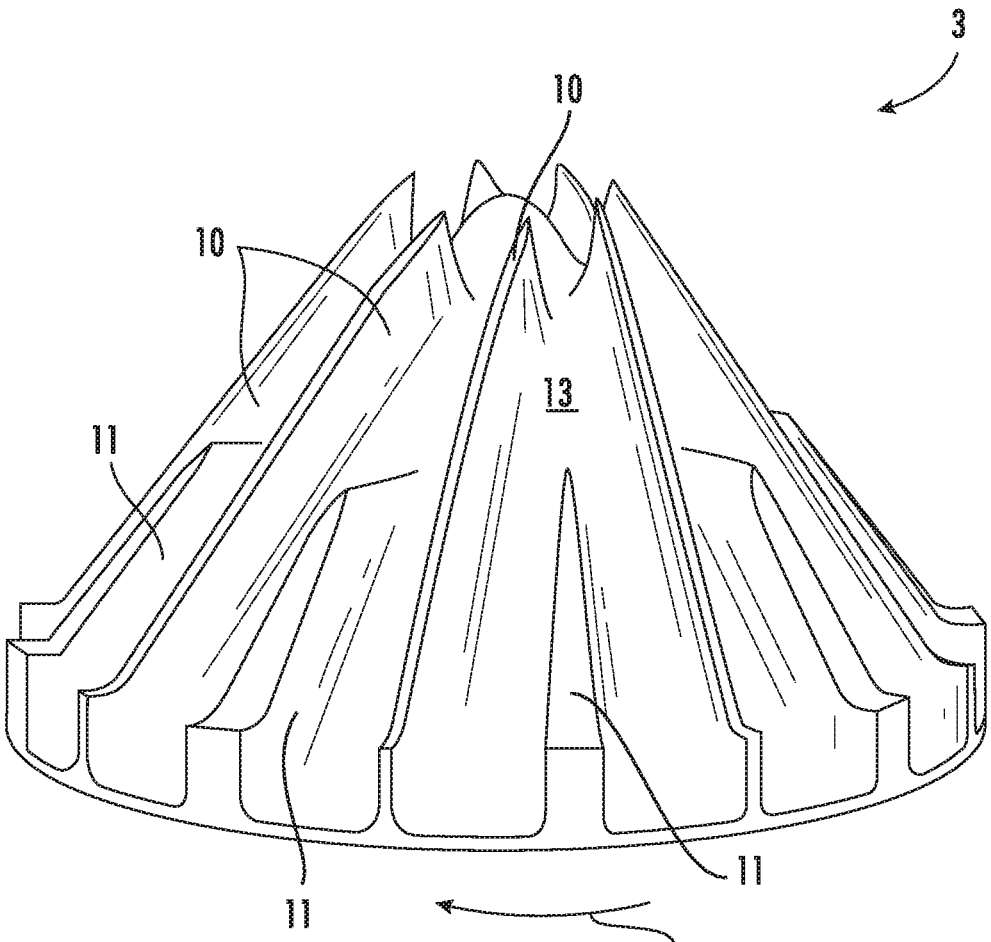
FIG. 2 shows an embodiment of the disclosed accelerator disc in 3D view.

FIG. 2 shows an embodiment of the accelerator disc 3 in a 3D view. Along the cone-shaped shell on the outside, blades 10 are arranged which are slightly curved in direction against the direction of rotation 12. Between such blades 10 are shorter blades 11 reaching to the end of the flow passage 13, dividing this passage 13 for better directing the suspension or mixture to the area of separation and further to the nozzles of a nozzle separator. The shorter blades 11 have a wider profile than the longer blades 10, which assists in stabilizing the shorter blades 11. The additional shorter blades 11 extend only along a part of the height of the cone-shaped shell and are arranged between blades 10 which extend along the whole height of the cone-shaped shell. Due to the curved blades, the power consumption of the disc stack separator can be reduced.

Figure 3:
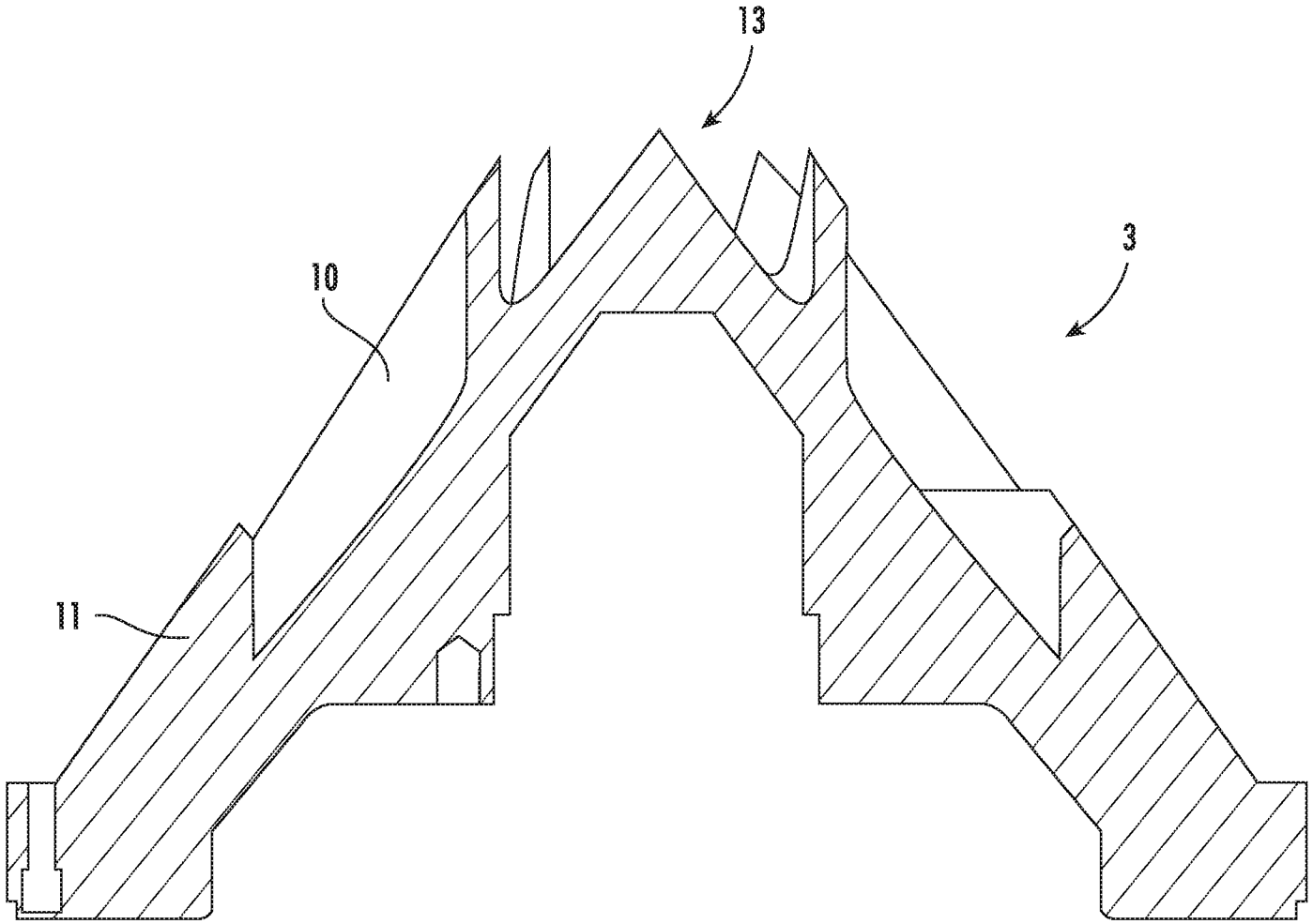
FIG. 3 shows a cross section of an accelerator disc according to the disclosure.

In FIG. 3, a cross section of an embodiment of the accelerator disc 3 is shown. This part is similar to the part in FIG. 1. From FIG. 1, it can be seen that the flow 13 of the suspension or mixture coming from the feed pipe 2 is directed to the top of the accelerator disc 3. If the flow has already a component in radial and in tangential direction by a special feed pipe with spiral grooves, the energy consumption can be reduced.

Figure 4:
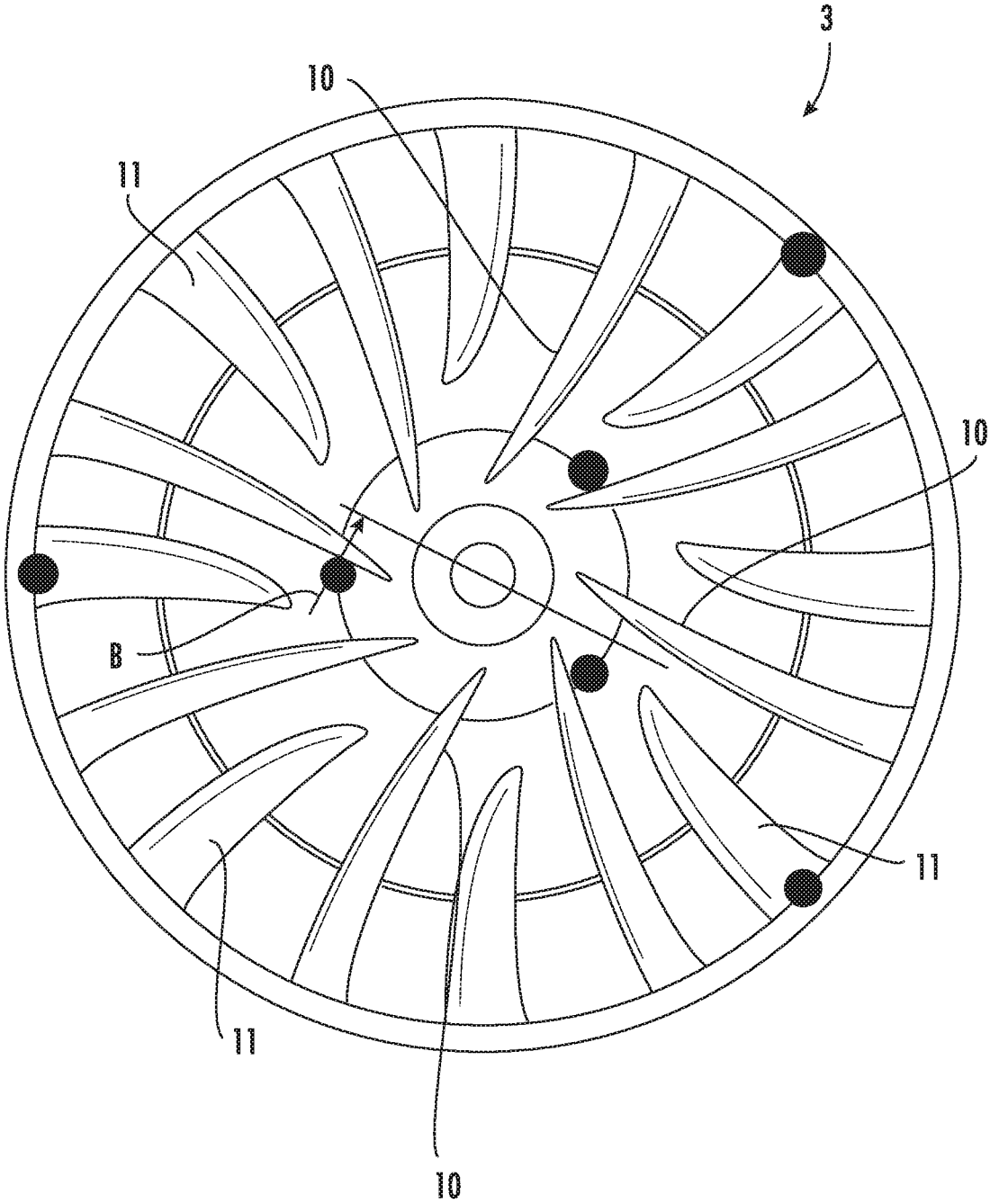
FIG. 4 shows a top view of an accelerator disc according to the disclosure.

FIG. 4 shows best the curved blades 10, and also curved blades 11 as a top view. The number of blades 10 and 11 can vary and depends on the whole outer diameter and also on the throughput and rotational speed of the bowl 4 (together with the accelerator disc 3 and disc stack 5), which may be up to 15,000 rpm or more in special cases.

Embodiments of the disc 3 have up to 50 blades.

Although the present disclosure has been described and illustrated in detail, it is to be clearly understood that this is done by way of example and not limitation. So the angle of the curved blades can be quite different for the material to be treated and the concentration of the suspension or mixture.

The invention claimed is:

1. An accelerator disc for a disc stack separator, the accelerator disc having a shape of a cone, comprising a cone-shaped outer shell having an outside surface and a height, and a plurality of blades (10, 11) mounted on the outside surface of the cone-shaped shell of the accelerator disc (3), wherein the blades (10, 11) are curved and at least some of the plurality of blades (10) extend along the entire height of the cone-shaped shell, the plurality of blades (10, 11) comprises shorter blades (11) and longer blades (10), the shorter blades (11) extending only partially along the height of the cone-shaped shell and the longer blades (10) extending along the entire height of the cone-shaped shell, and the shorter blades (11) have a wider profile than a profile of the longer blades (10).

2. The accelerator disc of claim 1, wherein the accelerator disc (3) is configured for rotation in the disc stack separator about an axis in a rotational direction, and the blades (10, 11) are curved in the direction opposite from the rotational direction.

3. The accelerator disc of claim 1, wherein each of the shorter blades (11) is arranged between longer blades (10).

4. The accelerator disc of claim 1, comprising up to 50 total blades (10, 11).

5. The accelerator disc of claim 2, comprising up to 50 total blades (10, 11).

6. The accelerator disc of claim 3, comprising up to 50 total blades (10, 11).

7. A disc stack separator, comprising an accelerator disc having a shape of a cone and comprising a cone-shaped outer shell having an outside surface and a height, and a plurality of blades (10, 11) mounted on the outside surface of the cone-shaped shell, wherein the blades (10, 11) are curved and at least some of the plurality of blades (10) extend along the entire height of the cone-shaped shell, the plurality of blades (10, 11) comprises shorter blades (11) and longer blades (10), the shorter blades (11) extending only partially along the height of the cone-shaped shell and the longer blades (10) extending along the entire height of the cone-shaped shell, and the shorter blades (11) have a wider profile than a profile of the longer blades (10).

8. The disc stack separator of claim 7, wherein the accelerator disc (3) rotates in the disc stack separator about an axis in a rotational direction, and the blades (10, 11) are curved in the direction opposite from the rotational direction.

9. The disc stack separator of claim 7, wherein each of the shorter blades (11) is arranged between longer blades (10).

10. The disc stack separator of claim 7, wherein the accelerator disc comprises up to 50 total blades (10, 11).

11. The disc stack separator of claim 9, wherein the accelerator disc comprises up to 50 total blades (10, 11).

12. The accelerator disc of claim 2, wherein each of the shorter blades (11) is arranged between longer blades (10).

13. The disk stack separator of claim 8, wherein each of the shorter blades (11) is arranged between longer blades (10).

* * * * *